United States Patent [19]

Randall

[11] Patent Number: 4,886,236

[45] Date of Patent: Dec. 12, 1989

[54] SUPPORT FOR SECURING A SHELF TO A WALL

[75] Inventor: Harold M. Randall, Fullerton, Calif.

[73] Assignee: Newell Operating Co., Memphis, Tenn.

[21] Appl. No.: 305,285

[22] Filed: Feb. 2, 1989

Related U.S. Application Data

[63] Continuation-in-part of Ser. No. 217,415, Jul. 11, 1988.

[51] Int. Cl.[4] ..... A47G 29/02

[52] U.S. Cl. ..... 248/250; 108/152; 211/90

[58] Field of Search ..... 248/250, 220.1, 316.2, 248/231.3, 235; 108/152; 211/90, 153, 134; D8/47

[56] References Cited

U.S. PATENT DOCUMENTS

| | | | |
|---|---|---|---|
| D. 238,745 | 2/1976 | Bedand | D8/47 |
| 1,939,408 | 12/1933 | Parlcer | 248/250 |
| 3,049,327 | 8/1962 | Caudell | 248/220.1 |
| 3,157,377 | 11/1964 | Orenick | 248/71 |
| 4,385,565 | 5/1983 | Roberts et al. . | |
| 4,508,301 | 4/1985 | Nicholson et al. . | |
| 4,691,887 | 9/1987 | Bessinger . | |

FOREIGN PATENT DOCUMENTS

| | | | |
|---|---|---|---|
| 670793 | 6/1937 | Fed. Rep. of Germany | 248/220.1 |
| 1147279 | 11/1902 | France | 248/250 |
| 1203070 | 1/1960 | France | 248/220.1 |

*Primary Examiner*—Alvin C. Chin-Shue
*Attorney, Agent, or Firm*—Walker & McKenzie

[57] ABSTRACT

A support for a shelf having a top surface, a bottom surface, a rear wall, and a front wall. The support includes a bracket having a throat for receiving the rear wall of a shelf; and one or more wedges for being inserted between the shelf and the throat of the bracket after the rear wall of the shelf has been received by the throat of the bracket to fix the shelf to the bracket. The shelf is attached to a wall by securing the bracket secured to the support member at the desired location; inserting the rear wall of the shelf into the throat of the bracket until the rear wall is adjacent the rear of the throat; and then inserting one or more wedge members into the throat of the bracket between the top surface of the shelf and the bottom surface of an upper arm of the bracket to fix the shelf to the bracket.

1 Claim, 3 Drawing Sheets

SUPPORT FOR SECURING A SHELF TO A WALL

CROSS-REFERENCE TO RELATED APPLICATION

This is a continuation-in-part of pending application Ser. No. 07/217,415, filed July 11, 1988, entitled "IMPROVED GLASS SHELF COMBINATION AND METHOD."

BACKGROUND OF THE INVENTION

1. Field of the Invention

The present invention relates, in general, to a support means for securing a glass shelf to a wall.

2. Description of the Related Art

Various means of mounting shelves to walls and the like have heretofore been patented. Roberts et al, U.S. Pat. No. 4,385,565, discloses a shelf support formed as a continuous section to run the length of the shelf and hold it as a cantilever by the co-operation of a support surface designed to lie below the shelf and a retaining ridge disposed to engage the upper face of the shelf near its edge. Nicholson et al, U.S. Pat. No. 4,508,301, provides the support surface of such a shelf support with a ramp surface to cause the retaining ridge to be urged upward when the shelf is inserted. Bessinger, U.S. Pat. No. 4,691,887, discloses a cantilever shelf bracket having a laterally oriented receiving throat containing a resilient insert which has depending flexible fingers capable of inward and upward deflection in varying amounts upon insertion of a shelf to allow the bracket to receive and retain a shelf made of varying thicknesses of glass, marble or the like without scratching, etc.

SUMMARY OF THE INVENTION

The present invention is directed toward providing an improved support means for mounting a glass shelf or the like to a wall. The concept of the present invention is to mount bracket means to a wall and then secure a shelf to the bracket means with one or more resilient wedge means for being wedged between the top of the shelf and the bottom of an upper arm of the bracket means.

The support means of the present invention includes bracket means for being secured to a wall, the bracket means including a body member having a rear side for being held against the wall; the bracket means including an upper arm member attached to the body member for extending outwardly from the wall, the upper arm member having a lower surface; the bracket means including a lower arm member attached to the body member at a spaced distance below the upper arm member for extending outwardly from the wall, the lower arm member having an upper surface; the space between the lower surface of the upper arm member and the upper surface of the lower arm member forming an elongated throat for receiving the rear wall of the shelf; and wedge means for being inserted between the top surface of the shelf and the lower surface of the upper arm member of the bracket means after the rear wall of the shelf has been received by the throat of the bracket means to fix the shelf to the bracket means.

DESCRIPTION OF THE PREFERRED EMBODIMENTS

Figure 1:
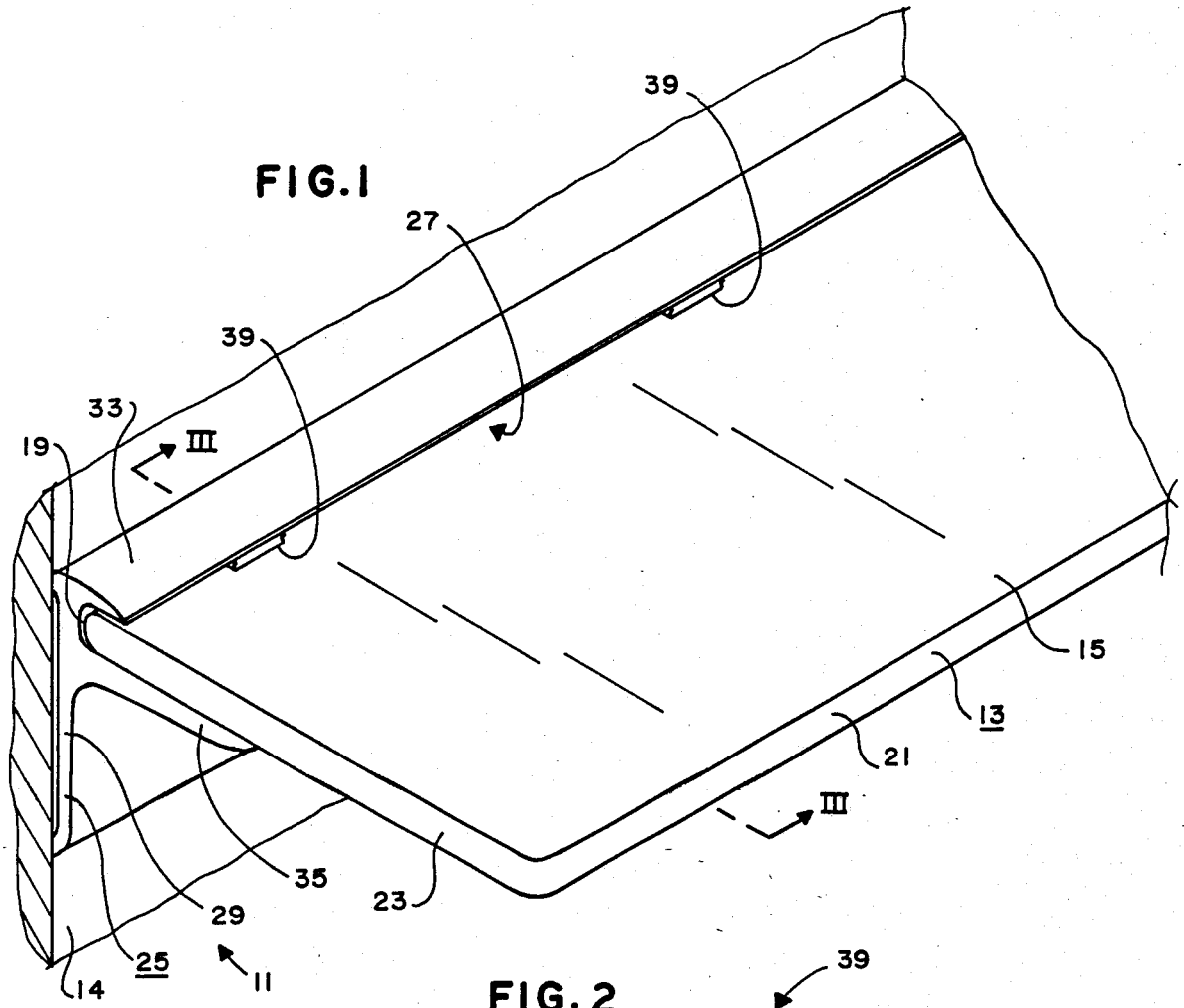
FIG. 1 is a perspective view of a first embodiment of the shelf support means of the present invention shown mounting a glass shelf to a vertical wall.

A first embodiment of the shelf support means of the present invention is shown in FIGS. 1–4 and identified by the numeral 11. The shelf support means 11 is used to mount a tempered glass shelf 13 or the like to a support member such as a wall 14 of a building or the like. The glass shelf 13 preferably has a flat top surface 15, a flat bottom surface 17, a rear wall 19 extending between the rear edges of the top and bottom surfaces 15, 17, a front wall 21 extending between the front edges of the top and bottom surfaces 15, 17, and side walls 23 extending between the side edges of the top and bottom surfaces 15, 17.

The shelf support means 11 includes bracket means 25 for being secured to the wall 14. The bracket means 25 has an elongated throat 27 for receiving the rear wall 19 of the shelf 13. The bracket means 25 preferably comprises an elongated metal member formed by extrusion or the like with a sleek cross-section shape as clearly shown in FIGS. 1, 3 and 4. The bracket means 25 preferably has a normally vertical body member 29 having a rear side 30 for being held against the wall 14 in an abutting manner by screws 31 or the like which extend through apertures or the like in the body member 29. The body member 29 has a front side, an upper end and a lower end. The bracket means 25 preferably has a normally horizontal first arm member 33 attached to the front side of the body member 29 adjacent the upper end thereof and extending outwardly therefrom and for extending outwardly from the wall 14. The first arm member 33 has an upper surface and a lower surface 34. The bracket means 25 preferably includes a normally horizontal second arm member 35 attached to the front side of the body member 29 at a spaced distance below the first arm member 33 and extending outwardly from the body member 29 and for extending outwardly from the wall 14. The second arm member 35 has an upper surface 36 and a lower surface. The throat 27 is defined by the space between the first and second arm members 33, 35 and the body member 29. More specifically, the height of the throat 27 is the distance between the lower surface 34 of the first arm member 33 and the upper surface 36 of the second arm member 35. The second arm member 35 preferably extends farther from the body member 29 than the first arm member 33 as clearly shown in the drawings to provide sufficient cantilever support for the shelf 13 as will now be apparent to those skilled in the art.

Figure 2:
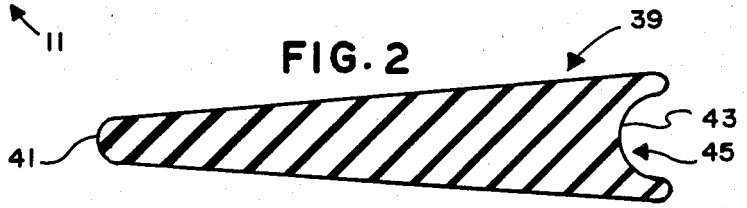
FIG. 2 is an enlarged sectional view of a wedge means of the first embodiment of the shelf support means of the present invention.
Figure 3:
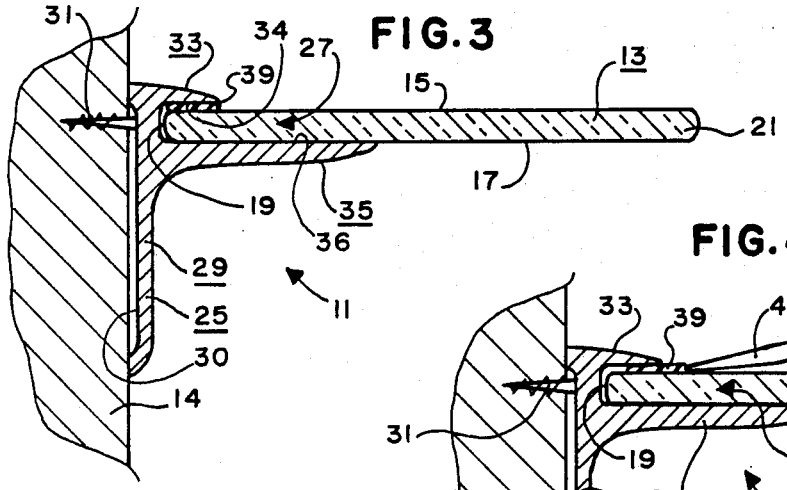
FIG. 3 is a sectional view substantially as taken on line III—III of FIG. 1.
Figure 4:
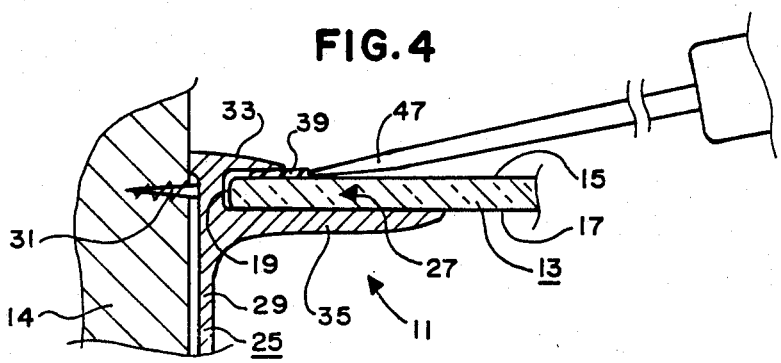
FIG. 4 is a sectional view substantially similar to FIG. 3 but showing a resilient wedge means of the shelf support means being wedged between the shelf and the throat of the bracket means.
Figure 5:
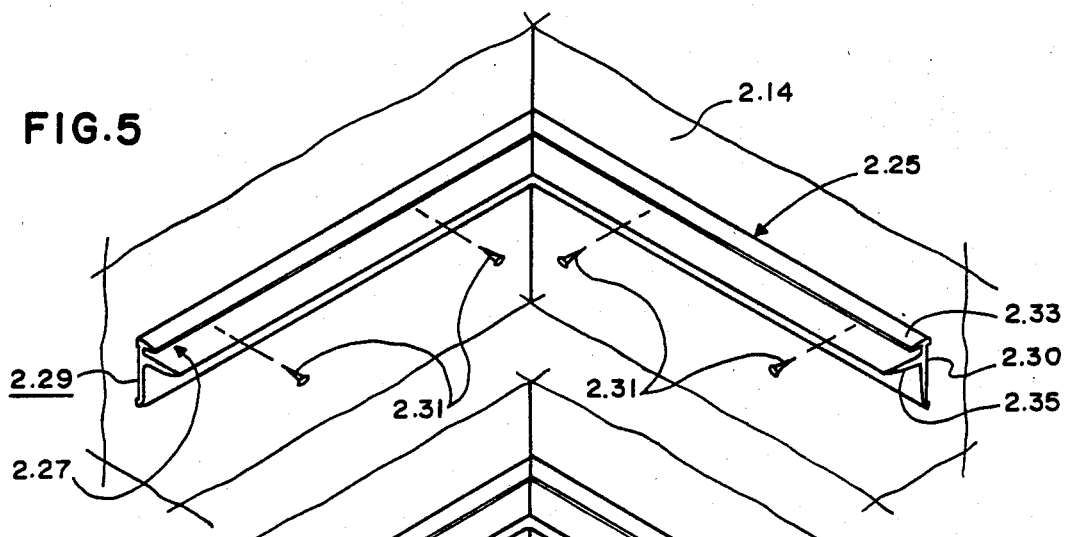
FIG. 5 is a perspective view of a second embodiment of the bracket means of the shelf support means of the present invention showing the bracket means being attached to a wall.
Figure 6:
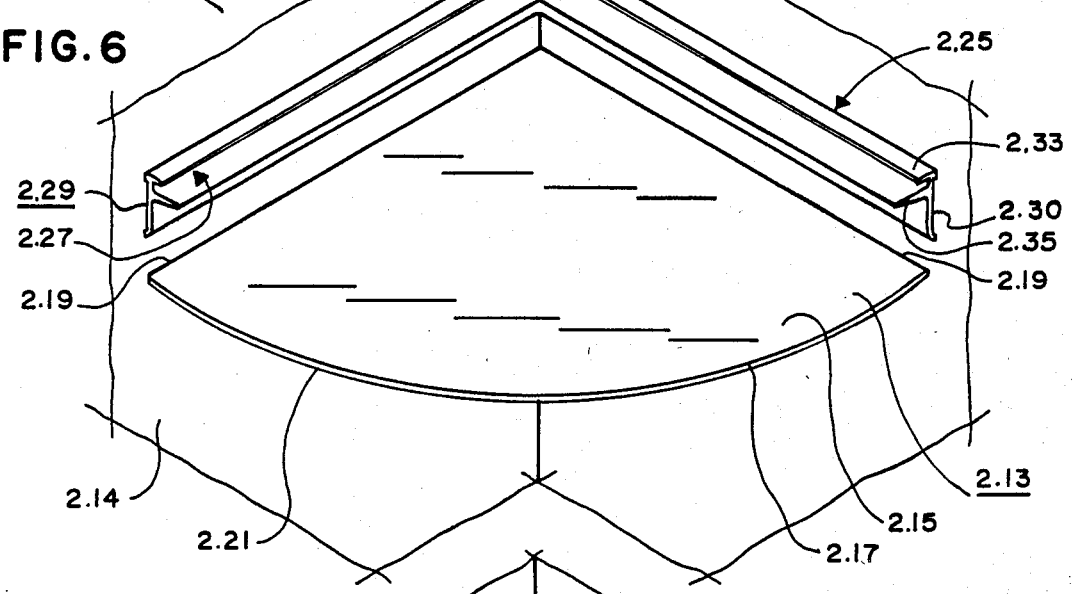
FIG. 6 is a perspective view similar to FIG. 5 but showing a shelf being inserted into the bracket means.

The shelf support means 11 includes wedge means for being inserted between the shelf 13 and the throat 27 of the bracket means 25 after the rear wall 19 of the shelf 13 has been received by the throat 27 of the bracket means 25 to fix the shelf 13 to the bracket means 25. The wedge means preferably consists of one or more wedge members 39 for being driven or forced between the top surface 15 of the shelf 13 and the lower surface 34 of the first arm member 33 as clearly shown in FIG. 4. Each wedge member 39 preferably has a substantially pointed, narrow forward end 41 and a rear end 43 that is relatively wide as compared to the forward end 41 to give each wedge member 39 a typically wedge-shaped cross section as clearly shown in FIG. 2. The rear end 43 of each wedge member 39 preferably has a notch or groove 45 thereacross as shown in FIG. 2. Each wedge member 39 is preferably formed of a resilient material such as, for example, rubber. Thus, each wedge member 39 will compress to some extent when wedged between the shelf 13 and the throat 27 of the bracket means 25 as shown in FIGS. 3 and 4. Preferably, each wedge member 39 is extruded or otherwise formed out of a flexible polyvinyl chloride having a hardness of 77 Shore or the like.

The method of mounting the shelf 13 to the wall 14 is quite simple. First, the bracket means 25 is secured to the wall 14 at the desired location using screws 31 or the like. Next, the rear edge of the shelf 13 is inserted into the throat 27 of the bracket means 25 until the rear wall 19 is adjacent the rear of the throat 27. One or more wedge members 39 are then inserted into the throat 27 of the bracket means 25 between the top surface 15 of the shelf 13 and the bottom or lower surface 34 of the first arm member 33 to fix or wedge the shelf 13 to the bracket means 25. The groove 45 on the rear end 43 of each wedge member 39 may be engaged by the end 47 of a tool or the like such as a screwdriver to aid in inserting the wedge members 39 into the throat 27 as shown in FIG. 4. Because the wedge members 39 are preferably made of resilient material, they will compress when inserted into the throat 27.

A second embodiment of the shelf support means of the present invention is shown in FIGS. 5–9 and identified by the numeral 2.11. The shelf support means 2.11 is used to mount a tempered glass corner shelf 2.13 or the like to a corner support member such as the inside corner 2.14 of a vertical wall. The corner shelf 2.13 preferably has a flat top surface 2.15, a flat bottom surface 2.17, a rear wall 2.19 extending between the rear edges of the top and bottom surface 2.15, 2.17, and a front wall 2.21 extending between the front edges of the top and bottom surfaces 2.15, 2.17. The rear wall 2.19 preferably has an angle or bend that corresponds with the angle or bend of the corner 2.14. Thus, the rear wall 2.19 will typically have a 90 degree angle or bend. The front wall 2.21 may curve from one end of the rear wall 2.19 to the other end thereof as clearly shown in FIG. 6.

The shelf support means 2.11 includes a bracket means 2.25 for being secured to the corner 2.14. The bracket means 2.25 has an elongated throat 2.27 for receiving the rear wall 2.19 of the shelf 2.13. The bracket means 2.25 preferably has a sleek cross-sectional shape identical to the cross-sectional shape of the bracket means 25 of the shelf support means 11. The bracket means 2.25 preferably has a normally vertical body member 2.29 having a rear side 2.30 for being held against the corner 2.14 in an abutting manner by screws 2.31 or the like which extend through apertures or the like in the body member 2.29. The body member 2.29 has a front side, an upper end and a lower end. The bracket means 2.25 preferably has a normally horizontal first arm member 2.33 attached to the front side of the body member 2.29 adjacent the upper end thereof and extending outwardly therefrom and for extending outwardly from the corner 2.14. The first arm member 2.33 has an upper surface and a lower surface 2.34. The bracket means 2.25 preferably includes a normally horizontal second arm member 2.35 attached to the front side of the body member 2.29 at a spaced distance below the first arm member 2.33 and extending outwardly from the body member 2.29 and for extending outwardly from the corner 2.14. The second arm member 2.35 has an upper surface 2.36 and a lower surface. The throat 2.27 is defined by the space between the first and second arm members 2.33, 2.35 and the body member 2.29. More specifically, the height of the throat 2.27 is the distance between the lower surface 2.34 of the first arm member 2.33 and the upper surface 2.36 of the second arm member 35. The second arm member 2.35 preferably extends farther from the body member 2.29 than the first arm member 2.33 as clearly shown in the drawings to provide sufficient cantilever support for the shelf 2.13 as will now be apparent to those skilled in the art. The bracket means 2.25 has an angle or bend that corresponds with the angle or bend of the corner 2.14. Thus, the bracket means 2.25 will typically have a 90 degree angle or bend substantially midway between the opposite ends thereof. The bracket means 2.25 preferably comprises an elongated metal member formed by extrusion or the like as a straight, elongated member identical to the bracket means 25 of the shelf support means 11 with a 90 degree groove or wedge 2.37 cut into the arm members 2.33, 2.35 at a point substantially intermediate the opposite ends thereof as clearly shown in FIG. 8 to allow the bracket means 2.25 to be bent to the 90 degree angle or bend shown in FIG. 9 as will now be apparent to those skilled in the art. An extension 2.38 of the apex of the groove or wedge 2.37 preferably extends into the body member 2.29 as clearly shown in FIG. 8 to allow the body member 2.29 to be smoothly bent to the 90 degree angle or bend as will now be apparent to those skilled in the art. The bracket means 2.25 is preferably formed of a soft aluminum alloy such as aluminum alloy #6063 with a hardness of T 52, as will be well known to those skilled in the art.

The shelf support means 2.11 includes wedge means for being inserted between the shelf 2.13 and the throat 2.27 of the bracket means 2.25 after the rear wall 2.19 of the shelf 2.13 has been received by the throat 2.27 of the bracket means 2.25 to fix the shelf 2.13 to the bracket means 2.25. The wedge means preferably consists of one or more wedge members 2.39 for being driven or forced between the top surface 2.15 of the shelf 2.13 and the lower surface 2.34 of the first arm member 2.33 as clearly shown in FIG. 7. Each wedge member 2.39 is identical to the wedge members 39 of the wedge means of the shelf support means 11 and preferably has a substantially pointed, narrow forward end 2.41 and a rear end 2.43 that is relatively wide as compared to the forward end 2.41 to give each wedge member 2.39 a typically wedge-shaped cross section as clearly shown in FIG. 2. The rear end 2.43 of each wedge member 2.39 preferably has a notch or groove 2.45 thereacross as shown in FIG. 2. Each wedge member 2.39 is preferably formed of a resilient material such as, for example, rubber. Thus, each wedge member 2.39 will compress to some extent when wedged between the shelf 2.13 and the throat 2.27 of the bracket means 2.25 as shown in FIGS. 3 and 4. Preferably, each wedge member 2.39 is extruded or otherwise formed out of a flexible polyvinyl chloride having a hardness of 77 Shore or the like.

Figure 7:
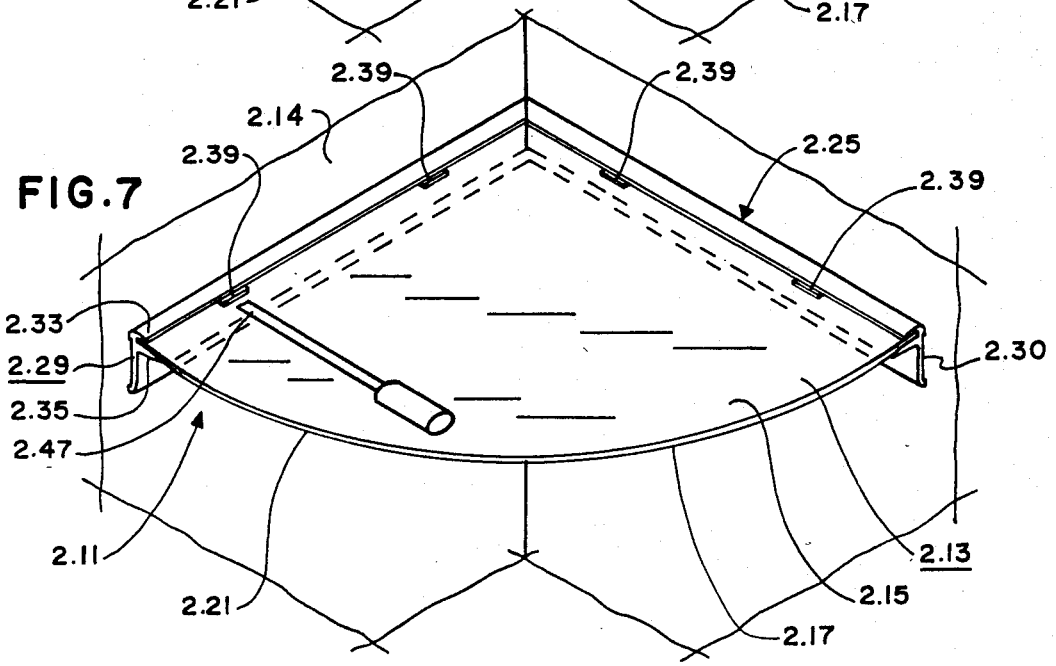
FIG. 7 is a perspective view similar to FIGS. 5 and 6 but showing wedge members being inserted between the top surface of the shelf and the bracket means to secure the shelf to the bracket means.
Figure 8:
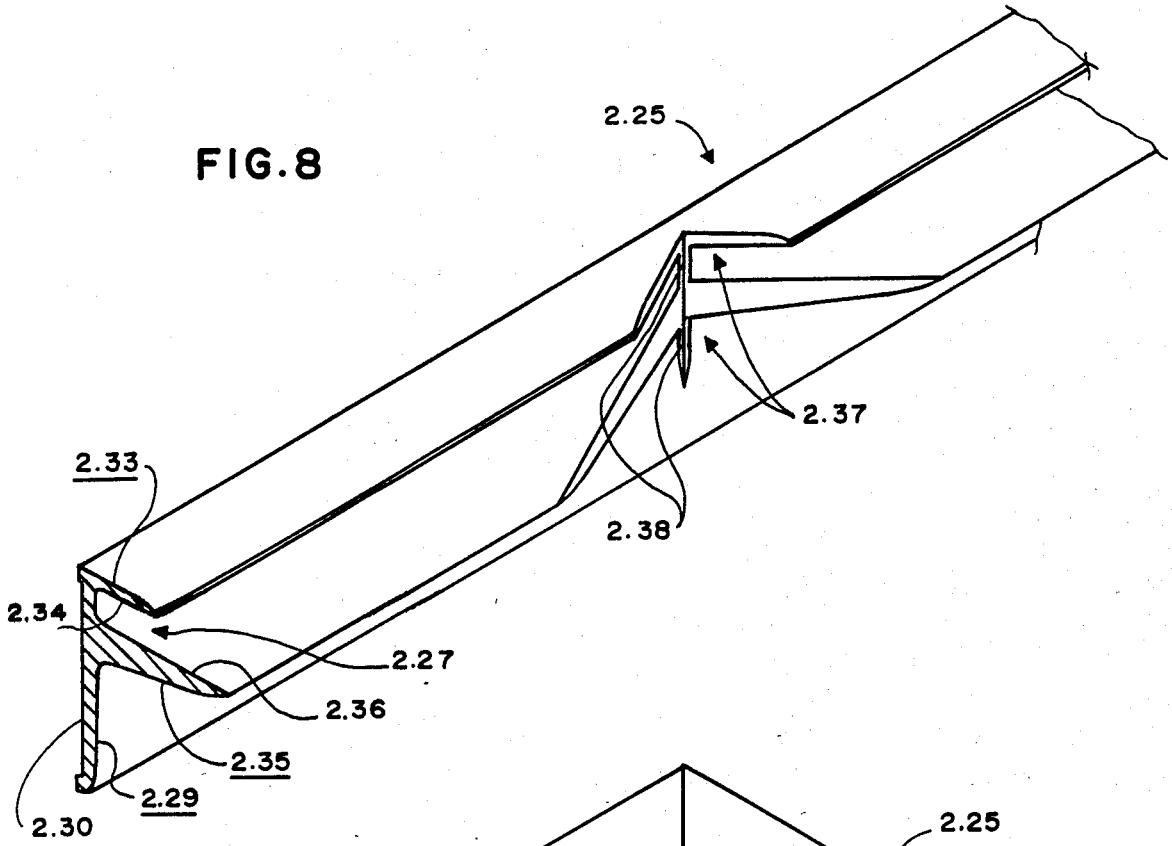
FIG. 8 is a perspective view of the shelf support means of FIGS. 5–7 during construction.
Figure 9:
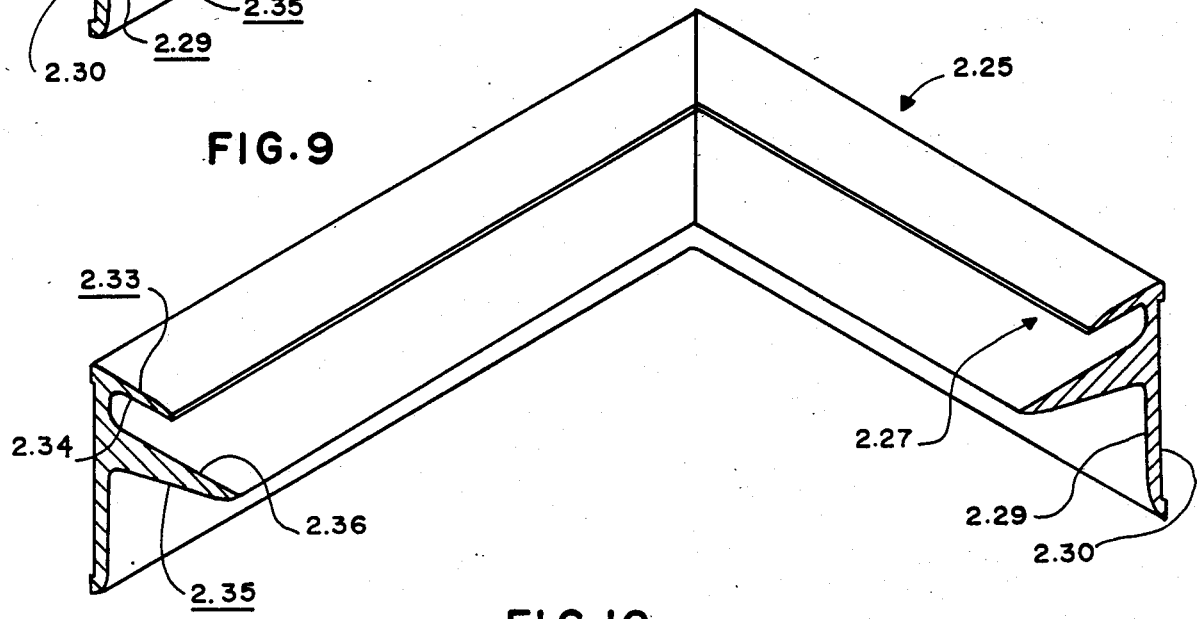
FIG. 9 is a perspective view of the shelf support means of FIG. 8 finished.
Figure 10:
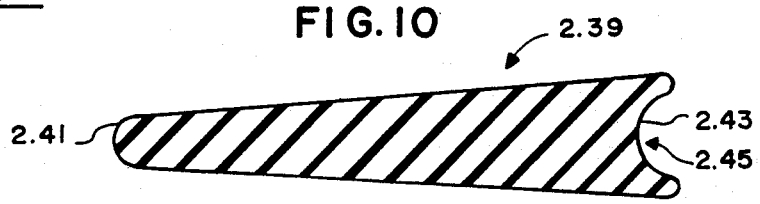
FIG. 10 is an enlarged sectional view of a wedge means of the second embodiment of the shelf support means of the present invention.

The method of mounting the shelf 2.13 to the corner 2.14 is quite simple. First, the bracket means 2.25 is secured to the corner 2.14 at the desired location using screws 2.31 or the like. Next, the rear edge of the shelf 2.13 is inserted into the throat 2.27 of the bracket means 2.25 until the rear wall 2.19 is adjacent the rear of the throat 2.27. One or more wedge members 2.39 are then inserted into the throat 2.27 of the bracket means 2.25 between the top surface 2.15 of the shelf 2.13 and the bottom or lower surface 2.34 of the first arm member 2.33 to fix or wedge the shelf 2.13 to the bracket means 2.25. The groove 2.45 on the rear end 2.43 of each wedge member 2.39 may be engaged by the end 2.47 of a tool or the like such as a screwdriver to aid in inserting the wedge member 2.39 into the throat 2.27 as shown in FIG. 7. Because the wedge members 2.39 are preferably made of resilient material, they will compress when inserted into the throat 2.27.

Although the present invention has been described and illustrated with respect to preferred embodiments and preferred uses therefor, it is not to be so limited since modifications and changes can be made therein which are within the full intended scope of the invention.

I claim:

1. In combination with a shelf and a wall, support means for securing said shelf to said wall, said shelf having a top surface, a bottom surface, a rear wall, and a front wall; said support means comprising:

(a) a one-piece, integral bracket means for being secured to said wall, said bracket including a body member having a rear side for being held against said wall; said bracket means including an upper arm member attached to said body member for extending outwardly from said wall, said upper arm member having a lower surface; said bracket means including a lower arm member attached to said body member at a spaced distance below said upper arm member for extending outwardly from said wall, said lower arm member having an upper surface; the space between said lower surface of said upper arm member and said upper surface of said lower arm member forming an elongated throat for receiving said rear wall of said shelf; and (b) wedge means for being inserted between said top surface of said shelf and said lower surface of said upper arm member of said bracket means after said bracket means has been secured to said wall and after said rear wall of said shelf has been received by said throat of said bracket means to fix said shelf to said bracket means; said wedge means including a plurality of resilient wedge members for being forced between said top surface of said shelf and said lower surface of said upper arm member of said bracket means; each wedge member having a substantially pointed, narrow forward end and a rear end that is relatively wide as compared to the forward end, said rear end of each wedge member has a groove there across, and said bracket means is bent at an angle to be attached to said wall at a corner.

* * * * *